US006883237B2

(12) United States Patent
Klatt et al.

(10) Patent No.: US 6,883,237 B2
(45) Date of Patent: Apr. 26, 2005

(54) DEVICE FOR CUTTING SPLIT ENDS USED WITH ELECTRIC HAIR CLIPPERS

(75) Inventors: Janette Klatt, Berka (DE); Peter Guss, Frankfurt (DE); Peter Scheunert, Dieburg (DE); Karl Trinkaus, Darmstadt (DE)

(73) Assignee: Wella Aktiengesellschaft, Darmstadt (DE)

( * ) Notice: Subject to any disclaimer, the term of this patent is extended or adjusted under 35 U.S.C. 154(b) by 43 days.

(21) Appl. No.: 10/332,415

(22) PCT Filed: Oct. 22, 2001

(86) PCT No.: PCT/EP01/12189

§ 371 (c)(1),
(2), (4) Date: Jan. 8, 2003

(87) PCT Pub. No.: WO02/36313

PCT Pub. Date: May 10, 2002

(65) Prior Publication Data

US 2003/0097756 A1 May 29, 2003

(30) Foreign Application Priority Data

Oct. 21, 2000 (DE) ..... 200 18 049 U

(51) Int. Cl.[7] ..... B26B 19/00
(52) U.S. Cl. ..... 30/124; 30/30
(58) Field of Search ..... 30/124, 192, 201, 30/30, 195, 210, 134, 216, 228, 135, 196, 208, 330, 341; 132/213, 132, 225, 214, 252, 223, 224, 212, 245, 259, 260, 251, 282, 226

(56) References Cited

U.S. PATENT DOCUMENTS 1,694,672 A * 12/1928 Rogler ..... 132/225
2,670,744 A * 3/1954 Levin ..... 132/213
2,718,231 A * 9/1955 De Lano ..... 132/213
3,115,143 A * 12/1963 Queen ..... 132/213
4,472,878 A * 9/1984 Miller ..... 30/201
5,832,939 A * 11/1998 Nathe ..... 132/225
5,884,402 A * 3/1999 Talavera ..... 30/124
6,141,877 A * 11/2000 Suetsugu ..... 30/195

FOREIGN PATENT DOCUMENTS

DE 3425052 A1 * 7/1984 ..... B26B/21/10
DE 34 25 052 A1 1/1985
DE 298 22 056 U 5/1999

* cited by examiner

*Primary Examiner*—Allan N. Shoap
*Assistant Examiner*—Ghassem Alie
(74) *Attorney, Agent, or Firm*—Michael J. Striker

(57) ABSTRACT

A split end cutting device (20.2) is embodied as an attachment (15.2), which can be detachably connected to a hair cutting machine (21), where the attachment (15.2) has first and second deflecting sections (41, 42), which are disposed parallel to and spaced apart from each other by a distance (X). By means of a hinge (14.2), a third deflecting section (43) can be moved from a first position (A) passing between the first and second deflecting sections (41, 42) into a second position (B) parallel to the first and second deflecting sections (41, 42), in such a way that a lock of hair (28) placed underneath the first and second deflecting sections (41, 42) is engaged from underneath by the third deflecting section (43) and essentially constitutes an upside down U-shape. A cutting head (27) with the hair cutting machine (21) is positioned in a stationary fashion in such a way that when the lock of hair (28) is pulled through over the deflecting sections (41, 42, 43), only the protruding split ends (30) in an upper region (Y) of the third deflecting section (43) are cut off by the cutting head (27).

16 Claims, 8 Drawing Sheets

DEVICE FOR CUTTING SPLIT ENDS USED WITH ELECTRIC HAIR CLIPPERS

BACKGROUND OF THE INVENTION

1. Field of the Invention

The invention relates to a device for cutting split ends, which is used in service industries (hair salons) and in the private sector for cutting hair ends that are split (split ends).

2. Description of the Related Art

It is known to twist hair with split ends into a lock in order to remove the protruding split ends manually with scissors. Since only the split ends of the hair on the outside of the lock are cut off in this case, this procedure must be repeated several times and therefore takes up a lot of time.

DE-OS 3422952 describes a split ends cutting device that permits damaged ends to be removed simply and quickly. In this case, the cutting device has a handle connected to a rod-shaped supporting part, whose circumferential surface has sets of parallel comb teeth extending over at least part of its length and at least one knife blade disposed between a pair of comb teeth sets, which the knife blade transfers. In its simplest embodiment, two rows of comb teeth are formed onto the supporting part of the cutting device, between which a fixed knife blade is situated. The knife blade is serrated, which is intended to assure a clean cutting of the hair ends. In another embodiment of the cutting device, which is particularly suited to electrical operation, the supporting part is comprised of a hollow body, whose wall has a slot between the rows of comb teeth. The knife blade is guided through the slot in the supporting part wall and is connected to a mount that is supported coaxial to the supporting part axis. An electric motor or vibrating magnetic drive mechanism is disposed in the handle as a drive mechanism for the blade mount and causes the mount to oscillate back and forth rapidly. It should be possible to use the above-described cutting device effectively for cutting spilt ends by guiding it several times with the knife blade side of the supporting part over the surface of a lock of hair, thereby cutting the tips caught by the comb teeth.

Because of its structural design, the end-cutting device described in this prior art is only partially suitable for removing split ends from the healthy hair. The placement of the knife blade directly against the lock of hair causes not only the split ends, but also the entire hair to be cut.

In addition, trouble-free hair cutting with a blade is only possible when the hair is wet, but then it is impossible to detect the split ends. By contrast, the dry knife cutting that must be used is unpleasant and painful. Since only thin locks of hair can be cut with this method and it is necessary to change the blade more frequently, the use of this hair end cutting device is very time and cost intensive.

SUMMARY OF THE INVENTION

The object of the invention is to produce a reasonably priced split end cutting device by means of which hair ends that are split (split ends) can be simply and conveniently removed from healthy hair and which is very quick and inexpensive to use.

According to the invention the split end cutting device for cutting split ends from a hair lock, which consists of an attachment for a hair cutting machine, comprises a first deflecting section and a second deflecting section arranged parallel to each other and spaced apart from each other a predetermined distance, X;

a third deflecting section pivotally mounted by means of a pivot device so as to be movable from a first position into a second position between the first and second deflecting sections, so that a hair lock engaged from underneath by the third deflecting section is pressed between the first and second and takes an upside-down U-shape; and means for detachably mounting the cutting head of the hair cutting machine in a fixed relation to the hair lock when the lock of hair is engaged underneath by the third deflecting section, so that, when the hair lock is drawn through the deflecting sections, the cutting head is mounted on the means for detachably mounting and the hair cutting machine is operated, only split ends protruding from the hair lock in an upper region of the third deflecting section are cut off by the cutting head.

According to a first exemplary embodiment the first and second deflecting sections comprise two rotating or stationary guide rollers, each mounted between opposing pivotally mounted jaws. The pairs of jaws on which the rollers are mounted are connected to each other by spring elements, which urge the guide rollers into a position separated from each other by the predetermined distance X. The third deflecting section takes the form of a pivotable hair lock support, which is pivotable from a first position into a second position between the two jaws of each pair of jaws.

According to this first exemplary embodiment of the invention, with the split end cutting device opened, the lock of hair to be treated is engaged from underneath by the hair lock support. During the opening and closing process, the guide rollers, which are pressed toward each other by spring force, are spread against the hair lock support and are moved across it. The enclosed lock of hair is fixed on the circumference of the hair lock support and is held tightly underneath the hair lock support by the guide rollers.

The split ends protruding from the circular cylindrical hair lock support are removed with an even cut by an electric hair cutting machine, which is spaced apart from the lock of hair and is disposed on a seat of the attachment.

In alternative embodiments the first and second deflecting sections are fixed between side walls of the attachment, have a U-shaped cross-section and are spaced at a fixed predetermined distance from each other. The third deflecting section takes the form of a pivotable hair lock support, which is pivotable from a first position into a second position between the first and second deflecting sections. The first and second deflecting sections each have a smooth bottom surface so that the hair lock can be drawn between them and the hair lock support when the hair lock is engaged from underneath by the hair lock support and held between the first and second deflecting sections bearing on their smooth bottom surfaces.

The invention will be explained in detail in conjunction with the following three exemplary embodiments.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
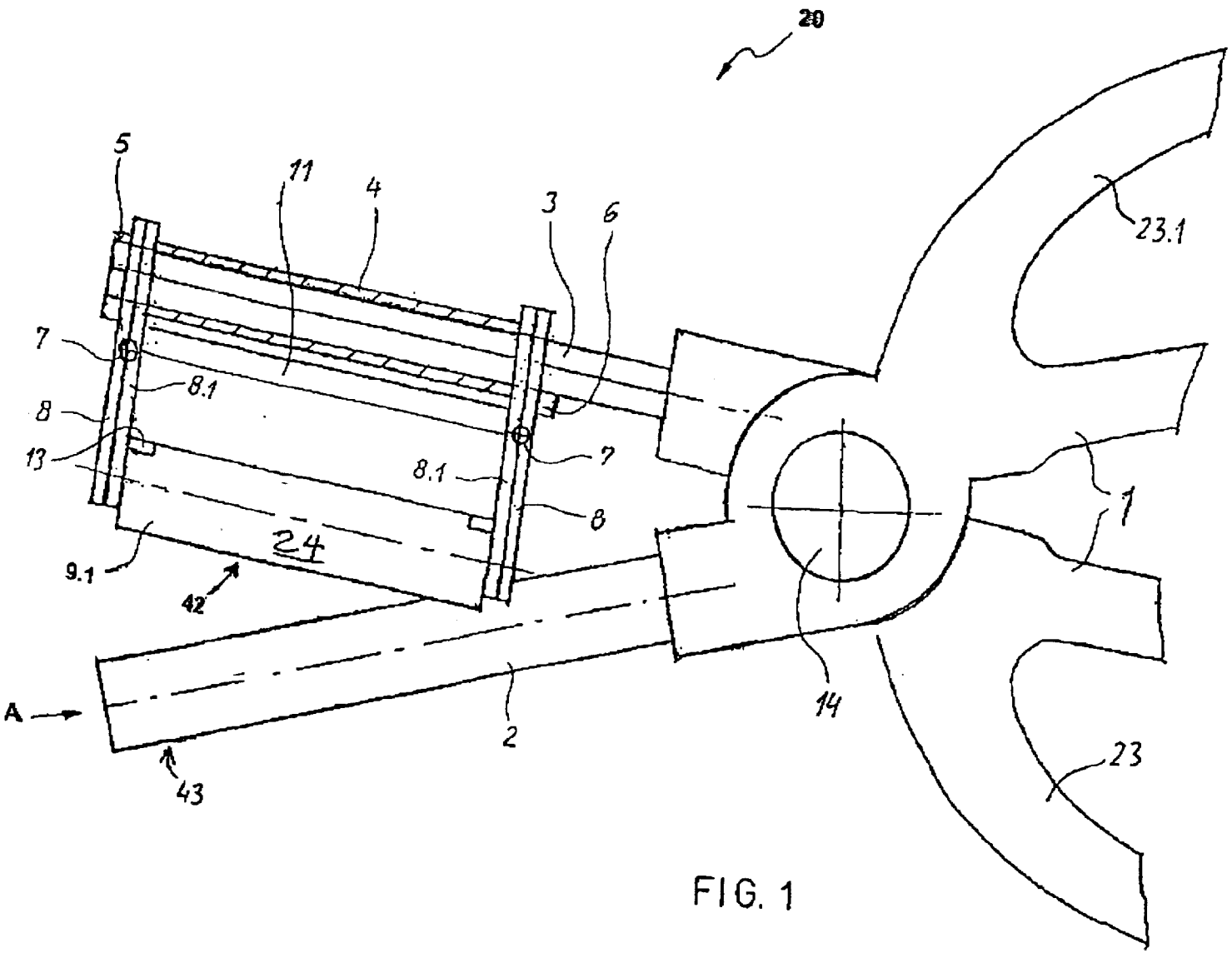
FIG. 1 shows a side view of an open split end cutting device according to a first exemplary embodiment.
Figure 2:
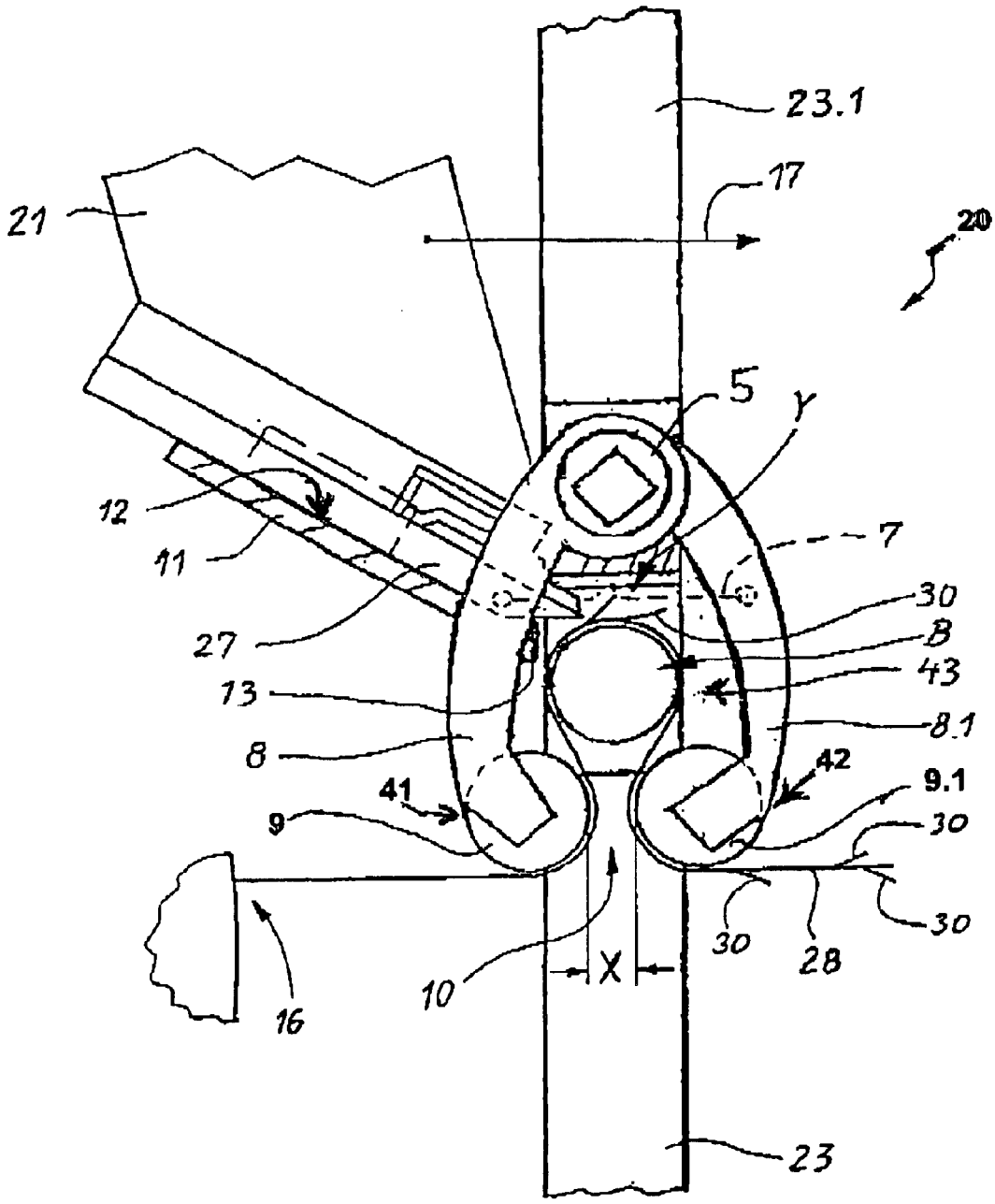
FIG. 2 shows a front view of the split end cutting device according to FIG. 1 with an enclosed lock of hair during a split end cutting procedure.

FIG. 1 shows a first exemplary embodiment of the split end cutting device 20 for an electric hair cutting machine 21 in which the split end cutting device 20 is embodied as an attachment that can be detachably connected to a hair cutting machine 21. The attachment has first and second deflecting sections 41, 42, which are disposed parallel to and spaced apart from each other by a distance X to form a hair lock guide channel 10. By means of a pivot 14, a third deflecting section 43 can be moved from a first position A, passing between the first and second deflecting sections 41, 42, into a second position B parallel to the first and second deflecting sections 41, 42. In the second position B a lock of hair 28 placed underneath the first and second deflecting sections 41, 42 is engaged from underneath by the third deflecting section 43. Then the lock of hair essentially takes an upside down U-shape. A hair cutting machine 21 is mounted on the spilt end cutting device 20 with its cuffing head 27 in a fixed position next to the hair lock 28 so that, when the lock of hair 28 is pulled through the hair lock guide channel 10 over the deflecting sections 41, 42, 43, only the protruding split ends 30 in an upper region Y of the third deflecting section 43 are cut off by the cutting head 27. For the sake of a very favorable operation the split end cutting device 20 is provided with a left- or right-handed pair of scissors handles 1 comprising two handle parts 23, 23.1 connected with a shared pivot 14. One handle part 23.1 has a circular cylindrical hair lock support 2 with a very smooth and slippery surface 24. The hand-actuated handle part 23 has a functional mounting bar 3 with a triangular or rectangular cross-section to prevent axial rotation. The mounting bar 3 extends parallel to the hair lock support 2 of handle part 23.1 when the scissors handles 1 are closed. The hair lock support 2 and the mounting bar 3 here can be inserted into the handle parts 23, 23.1, but can also be manufactured in one piece with the handle parts 23, 23.1 using an injection molding process. A circular cylindrical functional support 4, which has a suitable triangular or rectangular cross-sectioned inner receptacle 26 for the mounting bar 3, has bearing pins 5 at its ends. It can be slid onto the functional mount 3 at both ends and is fastened to it in a rotationally secured fashion by means of known fastening means, e.g. clips. Two pairs of jaws 8, 8.1, which are reflexively symmetrical to each other, are slid onto the bearing pins 5 of the functional support 4 and are secured in their position in relation to each other from the inside. Spring elements 7, which are embodied as compression springs above the bearing pins 5 or are embodied as tension springs below the bearing pins 5, urge the jaws 8, 8.1 of each pair toward each other until they are spaced apart by the distance X. The reflexively symmetrical jaws 8 or 8.1 are connected to each other by means of stationary or rotating guide rollers 9 or 9.1. Between the most distantly spaced jaws 8 of the opposed pairs of jaws 8, 8.1, there is a seat 11 for detachably mounting a cutting head 27 of an electric haircutting machine 21. The seat 11 is embodied after the fashion of an intrinsically known hair-thinning comb, which can be slid onto a haircutting machine 21. The functional support 4, the two pairs of jaws 8, 8.1 that can be moved toward each other by the spring elements 7, the guide rollers 9, 9.1 and the seat 11 in combination constitute an interchangeable structural unit, which, when slid onto the mounting bar 3, permits a neat removal of the split ends 30 in cooperation with the hair lock support 2. When the split end cutting device 20 is open, the hair lock support 2 engages the lock of hair 28, which is to be cut, from underneath and the centering protrusions 6, which are formed onto the functional support 4, thereby center the pairs of jaws and the guide rollers 9, 9.1 in relation to the hair lock support 2. During the closing of the split end cutting device 20, the hair lock support 2 pulls the lock of hair 28 between the automatically opening guide rollers 9, 9.1. When the split end cutting device 20 is closed, as shown in FIG. 2, the guide rollers 9, 9.1 hold the hair lock 28 tightly against the circumference of the hair lock support 2. In this connection, the shape of the jaws 8, 8.1 allow them to encompass the hair lock support 2 without touching it and consequently assure that the guide rollers 9, 9.1 can hold the hair lock against the hair lock support 2. When the lock of hair 28, starting from the base of the hair 16, is pulled through the hair lock guide channel 10 formed by the dosed split end cutting device 20, the circumferential grooves provided in the guide rollers 9, 9.1 allow for a uniform hair lock width and consequently an optimal cutting of the split ends 30. In this connection, the collar-like, raised ends of the guide rollers 9, which are inserted into the jaws 8, prevent individual hairs from catching. The split ends 30, which the hair lock support 2 causes to stick out, are removed with a straight cut in the direction of the arrow 17 by an electric hair cutting machine 21, which is detachably fitted onto the seat 11 and is aligned at an angle of, for example, 15 to 45 degrees in relation to the symmetry axis of the hair lock support 2, pointing toward the parallel guide rollers 9, 9.1. A cutting blade limiter 13, which spaces the electric hair cutting machine 21 apart from the hair lock support 2, prevents healthy hair strands from being cut. This procedure can be rapidly repeated with no trouble since only the split ends 30 are removed. The user of this split end cutting device 20 can decide based on his experience whether to use stationary guide rollers 9, 9.1 or rotating guide rollers 9, 9.1, depending on the type of hair. The ability of the functional support 4 to be slid onto the functional mounting bar 3 at both ends also assures that this split end cutting device 20 can be used by both right-handed and left-handed users.

FIGS. 3 to 8 show a second exemplary embodiment of a split end cutting device 20.1 for an electric hair cutting machine 21 in which the split end cutting device 20.1 is embodied as an attachment, which can be detachably connected to a hair cutting machine 21. The split end cutting device 20.1 has first and second deflecting sections 41, 42, which are disposed parallel to and spaced apart from each other by a distance X. The distance X is considerably greater than the diameter of the third deflecting section 43 so that the lock of hair 28 can slide unhindered against the first and second deflecting sections 41, 42. The first and second deflecting sections 41, 42 are connected to two side walls 29 of the attachment. By means of a pivot 14.1, a third deflecting section 43 can be moved from a first position A, passing between the first and second deflecting sections 41, 42, into a second position B parallel to the first and second deflecting sections 41, 42, in such a way that a lock of hair 28 placed underneath the first and second deflecting sections 41, 42 is engaged from underneath by the third deflecting section 43. It essentially takes an upside down U-shape, where a cutting head 27 with the hair cutting machine 21 is positioned in a stationary fashion in such a way that, when the lock of hair 28, starting from the base of the hair 16, is pulled through in the direction of arrow 17 over the deflecting sections 41, 42, 43, only the protruding split ends 30 in an upper region Y of the third deflecting section 43 are cut off by the cutting head 27. The first and second deflecting sections 41, 42 are affixed to the attachment. On one side of the attachment, the third deflecting section 43 is connected at one end to a pivot 14.1. A free end 44 of the third deflecting section 43 is provided with a guide handle 45 for moving the deflecting section 43 from a first position A into a second position B and vice versa. The first and second deflecting sections 41, 42 are provided with a U-shaped cross section, which means that they can be provided each in the form of an inexpensive injection-molded part. The third deflecting section 43 can be embodied so that it can be connected to the attachment 20.1 on the left or right side, which permits it to be used with either the left or right hand. The first, second, and third deflecting sections 41, 42, 43 are provided with a smooth surface 24 and can be alternatively provided in the form of a stationary or axially rotatable roller. In principle, merely a smooth surface 24 suffices in order to achieve a low friction between the deflecting sections 41, 42, 43 and the lock of hair 28. Except for the third deflecting section 43, the attachment is embodied in one piece made of plastic. In order to facilitate its operation, the third deflecting section 43 is provided with a detent mechanism 47 for securing it in position A and position B. For the detachable connection of the split end cutting device 20.1 to the hair cutting machine 21, the attachment 20.1 is provided with a seat 11 for the cutting head 27. The seat 11 is embodied after the fashion of an intrinsically known hair thinning comb, which can be slid onto a hair cutting machine 21.

Figure 4:
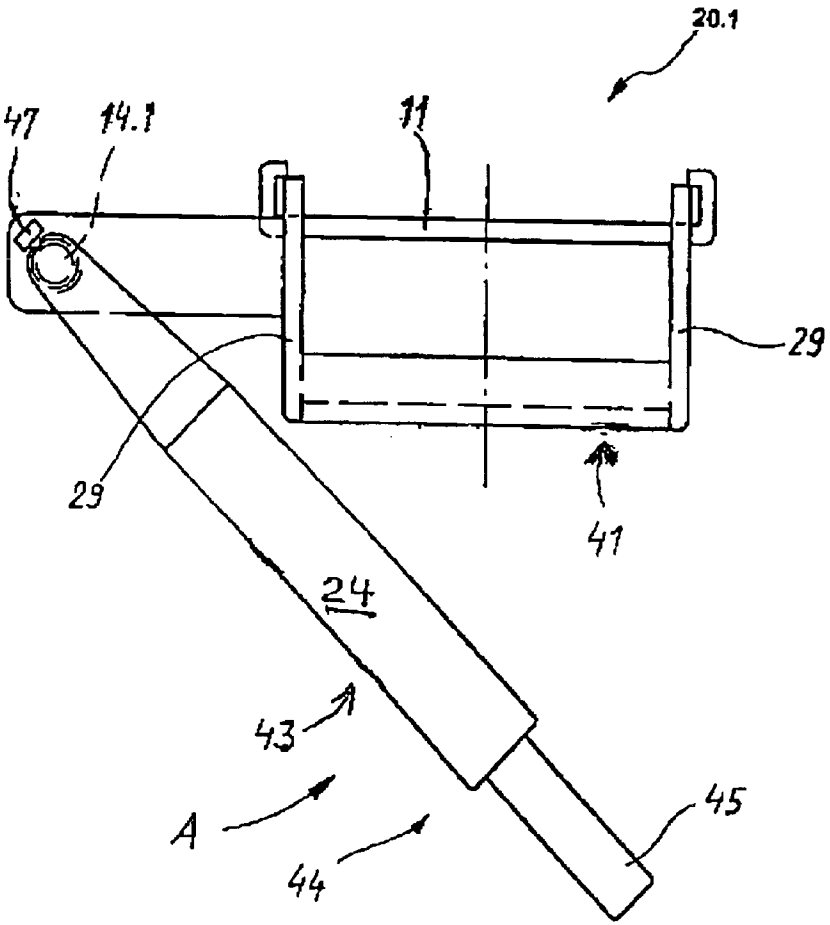
FIGS. 3 and 4 are respective side views of an open split end cutting device according to a second exemplary embodiment.
Figure 3:
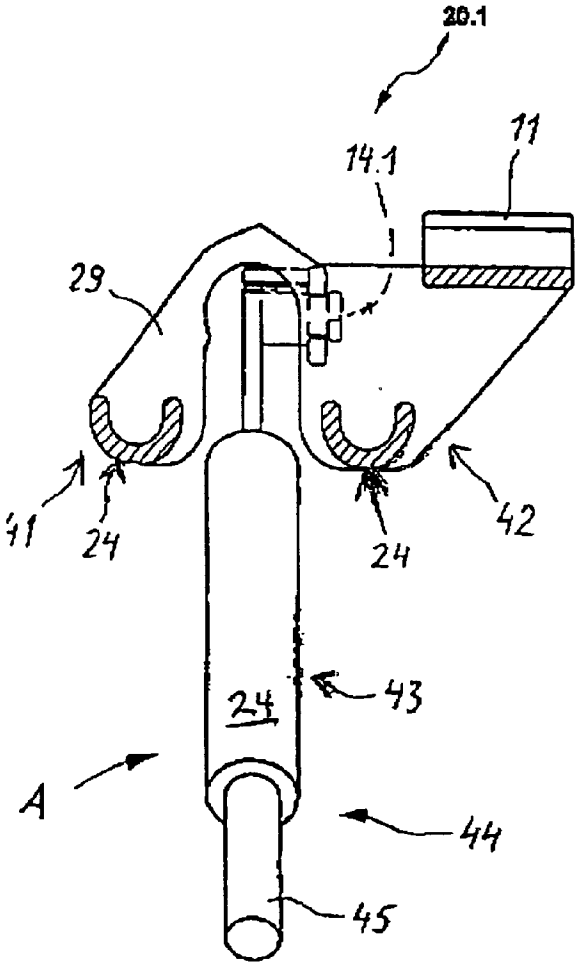
Figure 6:
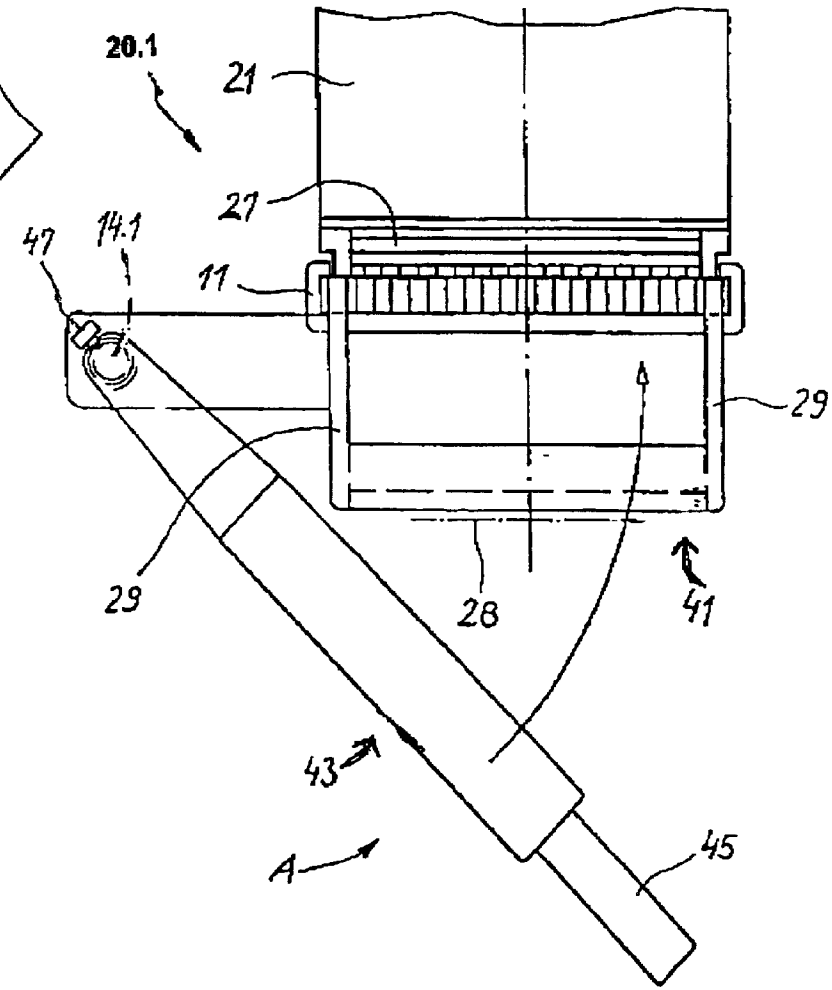
FIGS. 5 and 6 are respective side views of the open split end cutting device shown in FIGS. 3 and 4 with a hair cutting machine mounted on it.
Figure 5:
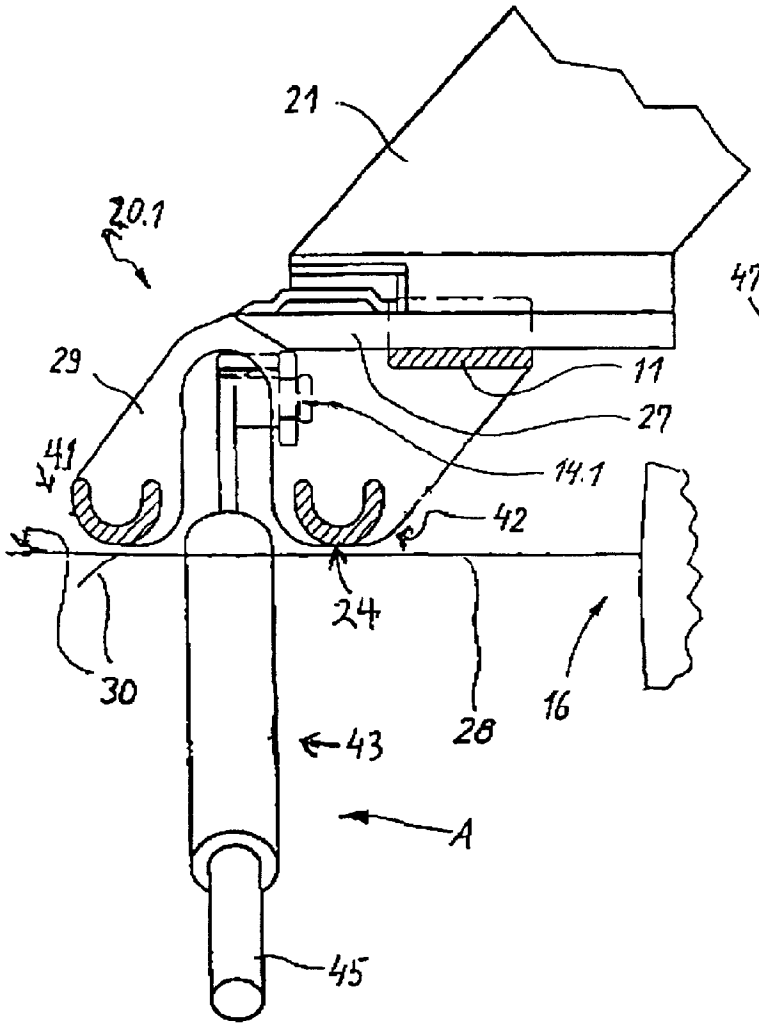

FIGS. 3 and 4 show different views of the attachment 20.1 with the third deflecting section 43 in a position A, without a hair cutting machine 21. By contrast, FIGS. 5 and 6 show the attachment from FIGS. 3 and 4 with the third deflecting section 43 in a position A, with a hair cutting machine 21 fixed in position and with a lock of hair 28.

Figure 8:
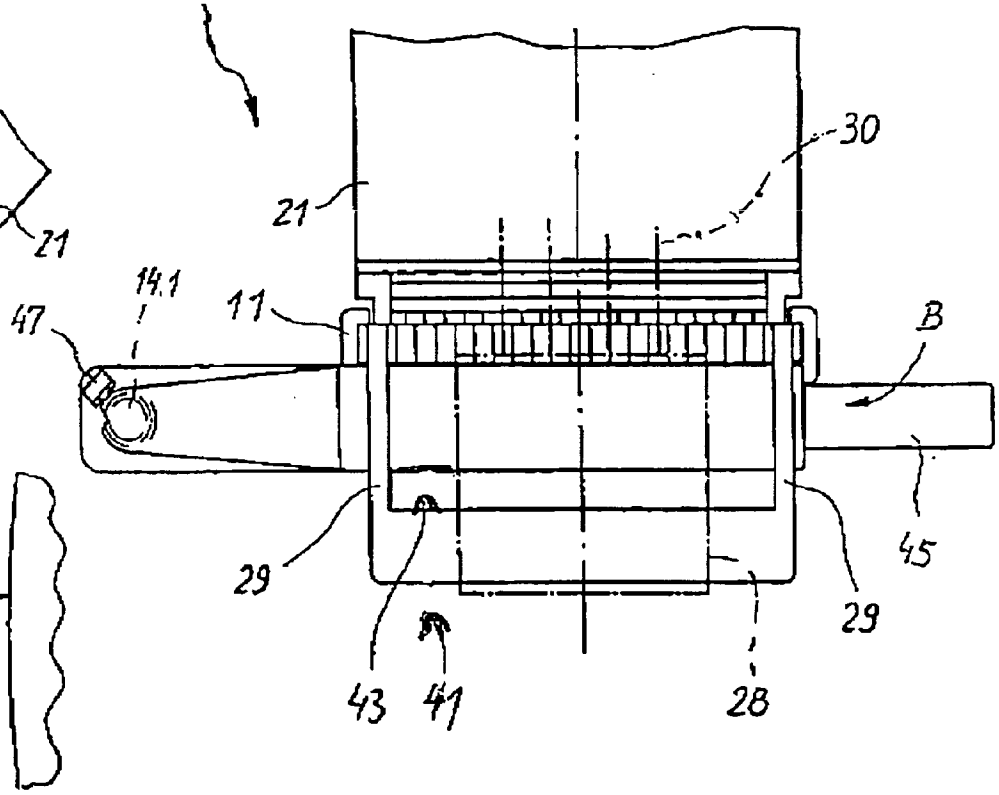
FIGS. 7 and 8 are respective side views of the apparatus shown in FIGS. 5 and 8 with the split end cutting device closed.
Figure 7:
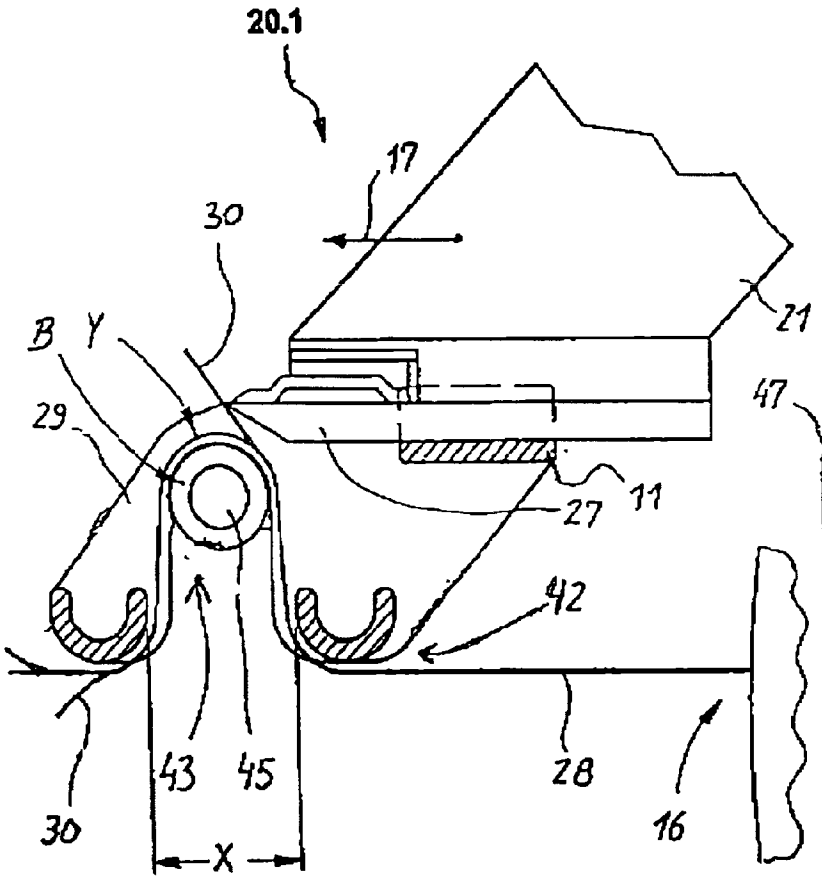

FIGS. 7 and 8 show different views of the attachment with the third deflecting section 43 in a position B, with the hair cutting machine 21, clarifying the position and function of the cutting head 27 for cutting off the protruding split ends 30. The seat 11 for the hair cutting machine 21 is embodied in such a way that the cutting head 27 is provided with a detent device so that its position is fixed.

FIGS. 9 to 14 show a third exemplary embodiment of a split end cutting device 20.2 for an electric hair cutting machine 21. This split end cutting device 20.2 is embodied as an attachment that can be detachably connected to a hair cutting machine 21. The attachment 20.2 has first and second deflecting sections 41, 42, which are disposed parallel to and spaced apart from each other by a distance X. The distance X is considerably greater than the diameter of the third deflecting section 43 so that the lock of hair 28 can slide unhindered against the first and second deflecting sections 41, 42. The first and second deflecting sections 41, 42 are connected to two side walls 29 of the attachment. By means of a pivot 14.2, a third deflecting section 43 can be moved from a first position A, passing between the first and second deflecting sections 41, 42, into a second position B parallel to the first and second deflecting sections 41, 42, in such a way that a lock of hair 28 placed underneath the first and second deflecting sections 41, 42 is engaged from underneath by the third deflecting section 43. The hair lock 28 essentially takes an upside down U-shape, where a cutting head 27 with the hair cutting machine 21 is positioned in a stationary fashion in such a way that, when the lock of hair 28, starting from the base of the hair 16, is pulled through in the direction of arrow 17 over the deflecting sections 41, 42, 43, only the protruding split ends 30 in an upper region Y of the third deflecting section 43 are cut off by the cutting head 27. The first and second deflecting sections 41, 42 are affixed to the attachment and the third deflecting section 43 is connected at one end to a pivoting lever 46, which is pivotably connected with a pivot 14.2 to the attachment in order to move the third deflecting section 43 from a first position A into a second position B and vice versa. Because of the structural arrangement with the pivoting lever 46, all of the deflecting sections 41, 42, 43 are always oriented parallel to one another, independent of the angular position of the pivoting lever 46 between position A and B. This reliably prevents an undesired slippage of a lock of hair 28 on the third deflecting section 43 during motion from position A toward position B. In addition, this achieves a very compact design of the split end hair cutting device 20.2. The first and second deflecting sections 41, 42 are provided with a U-shaped cross section, which means that they can be provided each in the form of an inexpensive injection-molded part. The third deflecting section 43 can be embodied so that it can be connected to the attachment on the left or right side, which means that the split end cutting device 20.2 can be used by both right-handed and left-handed people. The first, second, and third deflecting sections 41, 42, 43 are each provided with a smooth surface 24 and can be alternatively provided in the form of a stationary or axially rotatable roller. Except for the third deflecting section 43, the attachment is in one piece and made of plastic. In order to facilitate its operation, the third deflecting section 43 is provided with a detent mechanism 47 for position A and for position B. For the detachable connection of the split end cutting device 20.2 to the hair cutting machine 21, the attachment is provided with a seat 11 for the cutting head 27. The seat 11 is embodied after the fashion of an intrinsically known hair thinning comb, which can be slid onto a hair cutting machine 21. The third deflecting section 43 is provided with a hair lock pressing device 48, which corresponds at least to the first or second deflecting section 41, 42. This pressing device 48 additionally generates a slight tension on the lock of hair 28 being pulled through in order to deliberately cause the split ends 30 to protrude outward in the upper region Y of the third deflecting section 43. Advantageously, the hair lock pressing device 48 is provided with a brush 49 for pressing against the lock of hair 28.

Figure 10:
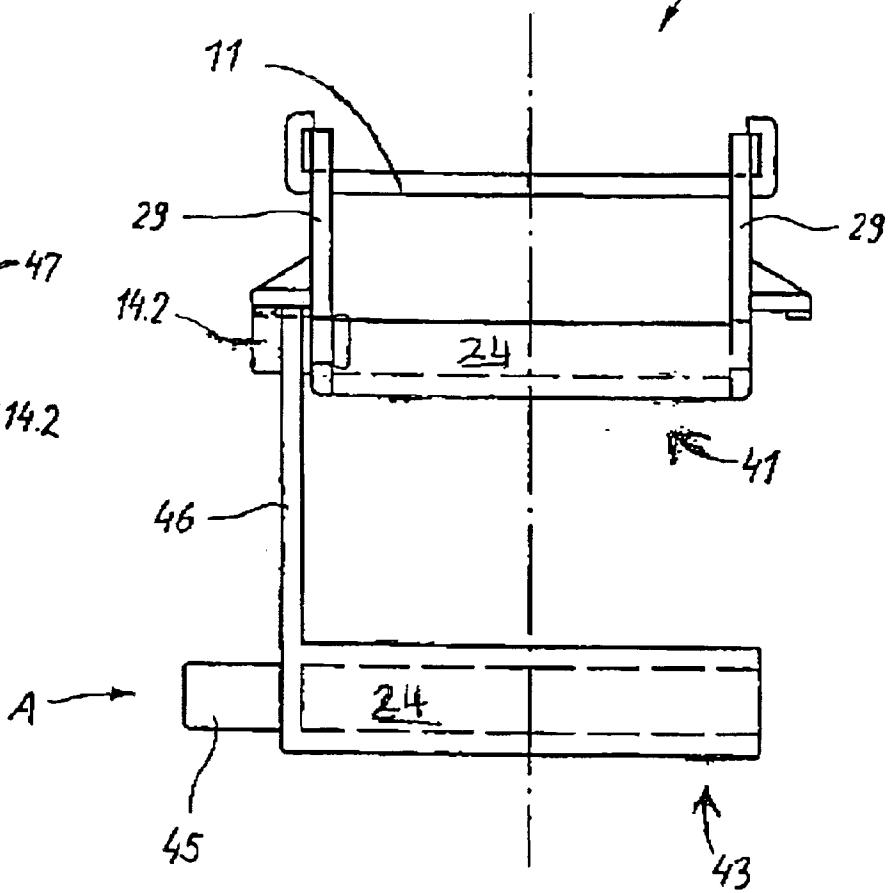
FIGS. 9 and 10 are respective side views of an open split end cutting device according to a third exemplary embodiment.
Figure 9:
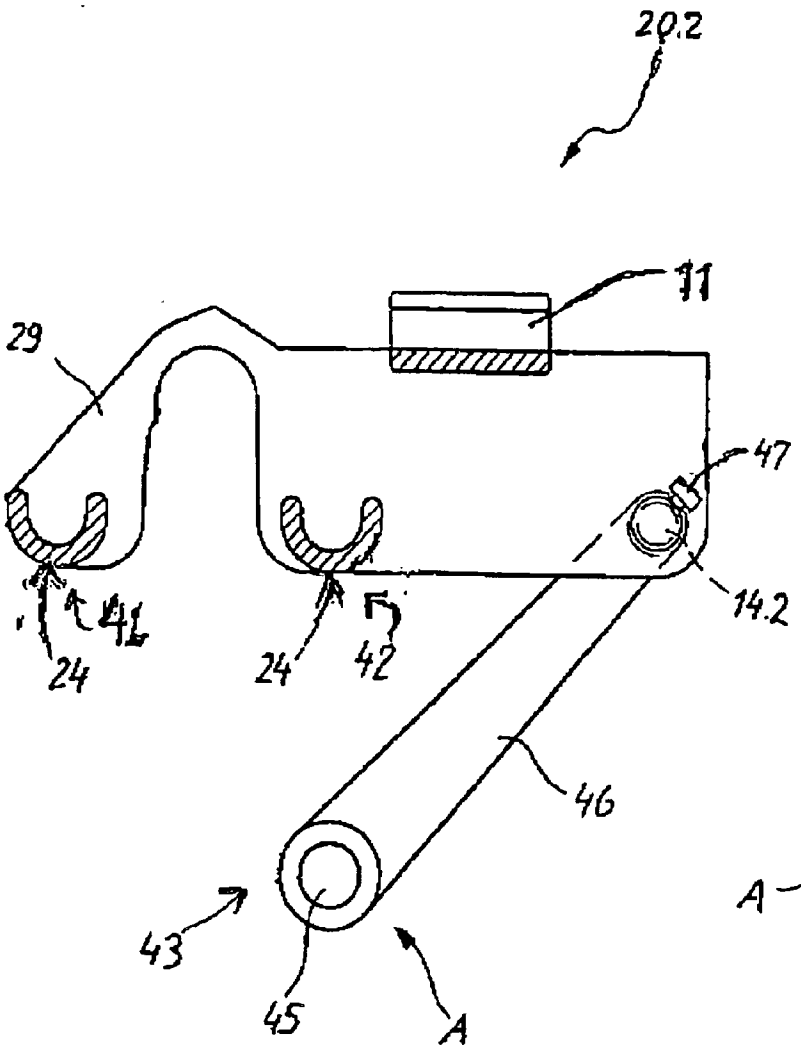
Figure 12:
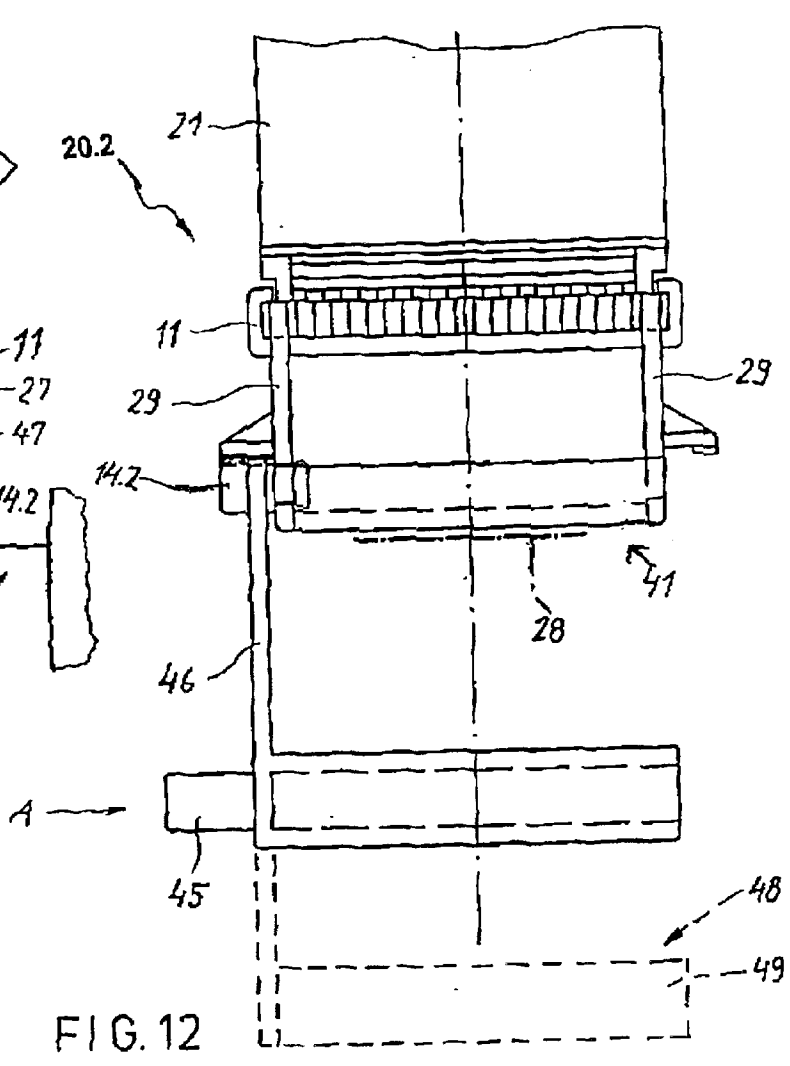
FIGS. 11 and 12 are respective side views of the open split end cutting device shown in FIGS. 9 and 10 with a hair cutting machine mounted on it.
Figure 11:
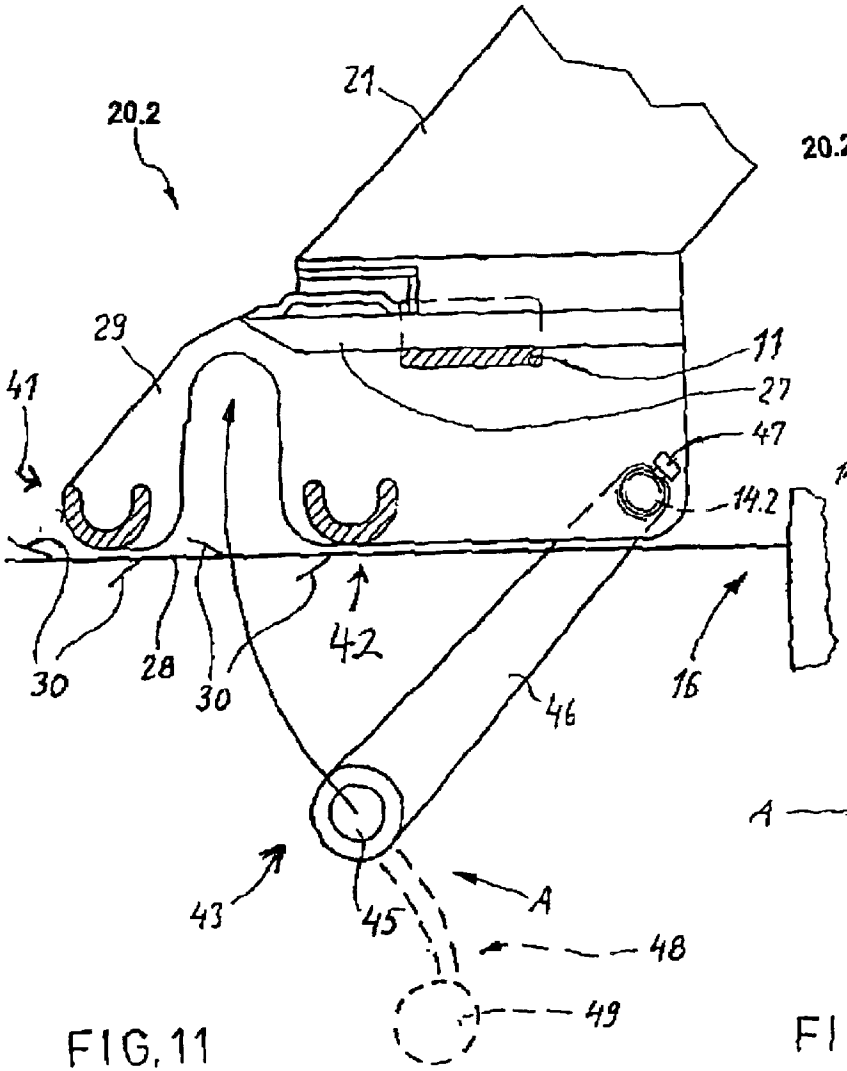

FIGS. 9 and 10 show different views of the split end cutting device 20.2 with the third deflecting section 43 in a position A, without a hair cutting machine 21. By contrast, FIGS. 11 and 12 show the device 20.2 from FIGS. 9 and 10 with the third deflecting section 43 in a position A, with a hair cutting machine 21 fixed in position and with a lock of hair 28.

Figure 14:
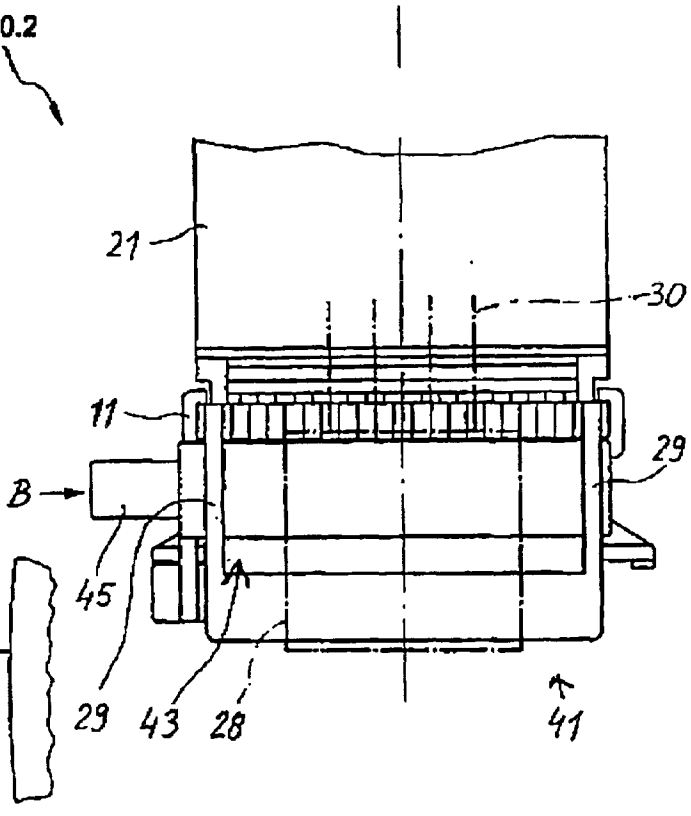
FIGS. 13 and 14 are respective side views the apparatus shown in FIGS. 11 and 12 with the split end cutting device closed.
Figure 13:
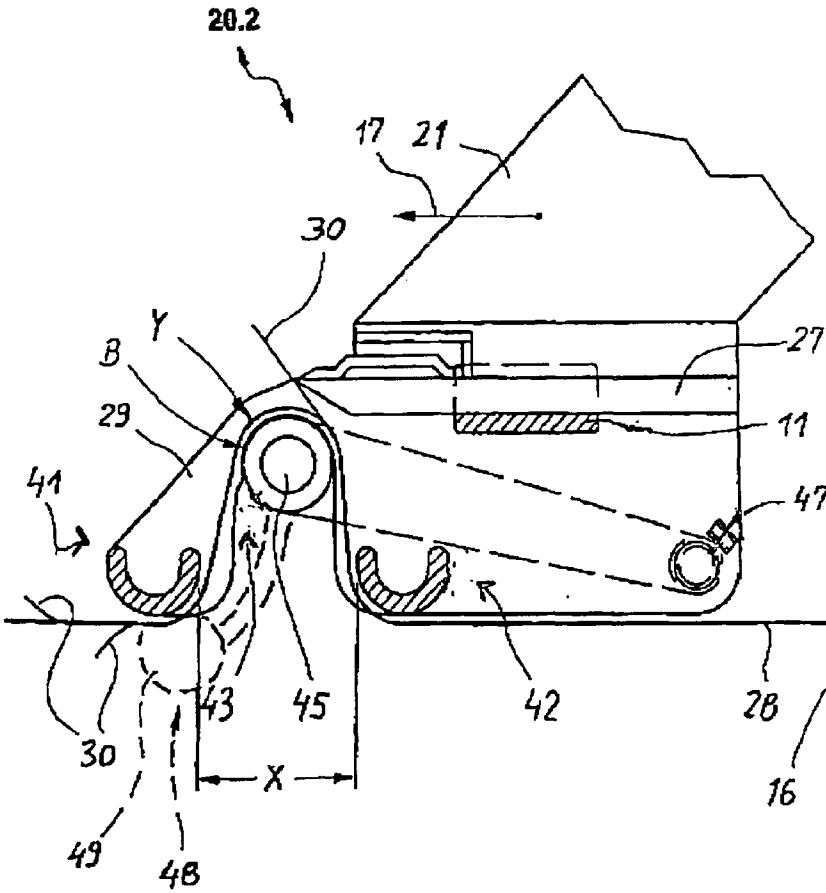

FIGS. 13 and 14 show different views of the split end cutting device 20.2 with the third deflecting section 43 in a position B, with the hair cutting machine 21, clarifying the position and function of the cutting head 27 for cutting off the protruding split ends 30 from the hair lock 28. The seat 11 for the hair cutting machine 21 is embodied in such a way that the cutting head 27 is provided with a detent device so that its position is fixed.

What is claimed is:

1. A split end cutting device (20) for cutting split ends from a lock of hair (28), said split end cutting device (20) consisting of an attachment for a hair cutting machine (21), said hair cutting machine (21) including a cutting head (27) for cutting said hair; and wherein said split end cutting device comprises a first deflecting section (41) and a second deflecting section (42) arranged parallel to each other and spaced apart from each other by a distance (X);

a third deflecting section (43) pivotally mounted by means of a pivot (14, 14.1, 14.2) so as to be movable from a first position (A) passing between said first deflecting section (41) and said second deflecting section (42) into a second position (B) parallel to said first deflecting section (41) and to said second deflecting section (42) so that said lock of said hair placed underneath said first deflecting section (41) and said second deflecting section is engaged from underneath by said third deflecting section (43) and essentially takes an upside-down U-shape; and means (11) for detachably mounting said cutting head (27) of the hair cutting machine (21) in a fixed position in relation to said lock of said hair (28) when said lock of said hair (28) is engaged underneath by said third deflecting section (43) and essentially takes said upside-down U-shape, so that, when said lock of said hair is drawn through said deflecting sections (41, 42, 43) and said hair cutting machine (21) is operated, only split ends (30) protruding from said lock of said hair (28) in an upper region (Y) of said third deflecting section (43) are cut off by said cutting head (27).

2. The split end cutting device (20) as defined in claim 1, wherein said first deflecting section (41) and said second deflecting section (42) are fixed in position in the attachment so that said distance (X) is fixed, said pivot (14.1) is arranged at one side of the attachment, said third deflecting section (43) is connected at one end to said pivot (14.1) and said third deflecting section (43) has a guide handle (45) at another free end opposite from said one end for moving the third deflecting section (43) from said first position (A) to said second position (B), and vice versa.

3. The split end cutting device as defined in claim 1, wherein said first deflecting section (41) and said second deflecting section (42) are fixed in position in the attachment so that said distance (X) is fixed, said third deflecting section (43) is connected at one end to a pivoting lever (46), said pivoting lever (46) is pivotally connected with said pivot (14.2) in order to move the third deflecting section (43) from said first position (A) to said second position (B), and vice versa.

4. The split end cutting device as defined in claim 1, 2 or 3, wherein said first deflecting section (41) and said second deflecting section (42) are each provided with a U-shaped cross section.

5. The spilt end cutting device as defined in claim 1, 2 or 3, wherein said pivot (14, 14.1, 14.2) is mounted on a left side or a right side of said attachment to facilitate pivoting of said third deflecting section (43) by a right-handed or left-handed operator.

6. The split end cutting device as defined in claim 1, 2 or 3, wherein said first deflecting section (41), said second deflecting section (42) and said third deflecting section (43) are each provided with a smooth bearing surface (24) for the lock of the hair (28).

7. The split end cutting device as defined in claim 1, 2 or 3, wherein said first deflecting section (41), said second deflecting section (42) and said third deflecting section (43) are each in the form of a stationary or axially rotatable roller (9, 9.1).

8. The split end cutting device as defined in claim 2 or 3, wherein the attachment (15.1, 15.2) is embodied in one piece made of plastic, except for said third deflecting section (43).

9. The split end cutting device as defined in claim 2 or 3, further comprising a detent mechanism (47) for securing the third deflecting section (43) in said position (A) or said position (B).

10. The split end cutting device as defined in claim 2 or 3, further comprising a seat (11) for detachably mounting the cutting head (27) in a fixed position in relation to the lock of the hair when said lock of said hair (28) is engaged underneath by said third deflecting section (43) and essentially takes said upside-down U-shape so that said split ends (30) can be cut off.

11. The split end cutting device as defined in claim 1, further comprising a hair lock pressing device (48) connected with the third deflection section (43), said hair lock pressing device corresponding to the first deflecting device (41) or the second deflecting device (42).

12. The split end cutting device as defined in claim 11, wherein the hair lock pressing device (48) is provided with a brush (49).

13. The split end cutting device as defined in claim 1, further comprising scissors handles (1) pivotally connected with each other by said pivot (14), said scissors handles (1) comprising two handle parts (23, 23.1) connected by said pivot (14), one (23.1) of which is a circular cylindrical hair lock support (2) having a smooth bearing surface (24) for the lock of the hair and another (23) of which comprises a mounting bar (3) with a triangular or rectangular cross-section to prevent axial rotation, which extends parallel to the hair lock support (2) when said scissors handles (1) are closed;

a circular cylindrical functional support (4) including bearing pins (5) on opposite ends thereof and provided with a corresponding triangular or rectangular cross-sectioned inner receptacle (26) for insertion of the mounting bar (3) so that said functional support (4) is fastenable on said mounting bar (3) in a rotationally secured fashion;

two pairs of jaws (8, 8.1), which are reflexively symmetrical to each other, are slid onto the bearing pins (5) on said opposite ends of the functional support (4) and are secured in position in relation to each other;

spring elements (7), which are embodied as compression springs if installed above said bearing pins (5) or are embodied as tension springs if installed below said bearing pins (5), for urging said jaws (8, 8.1) of each of said pairs toward each other until spaced apart by a predetermined distance (X); and a seat (11) for detachably mounting the cutting head (27) of the electric hair cutting machine (21), said seat (11) being arranged between said pairs of said jaws;

wherein said first deflecting section (41) and said second deflecting section (42) each comprise a stationary or rotating guide roller (9, 9.1) extending between respective jaws of each of said pair of said jaws.

14. The split end cutting device as defined in claim 13, further comprising an interchangeable structural unit comprising the functional support (4), the two pairs of the jaws (8, 8.1), the spring elements (7), the guide rollers (9, 9.1) and the seat (11) and wherein said structural unit, when slid onto the mounting bar (3), permits a neat removal of said split ends (30) in cooperation with said hair lock support (2).

15. The split end cutting device as defined in claim 13, wherein said seat (11) is aligned at an angle of 15 to 45 degrees in relation to a symmetry axis of the hair lock support (2).

16. The split end cutting device as defined in claim 13, further comprising a cutting blade limiter (13), which spaces the electric hair cutting machine 21 apart from the hair lock support (2), to prevent healthy hair strands from being cut.

* * * * *